United States Patent [19]

Adams et al.

[11] Patent Number: 4,722,674

[45] Date of Patent: Feb. 2, 1988

[54] COMBUSTION AIR BLOWER MOTOR ISOLATING SPRING

[75] Inventors: Charles W. Adams, Richardson; David B. Schumacher, Lewisville, both of Tex.

[73] Assignee: Lennox Industries, Inc., Dallas, Tex.

[21] Appl. No.: 875,996

[22] Filed: Jun. 19, 1986

[51] Int. Cl.[4] ..... F04B 17/00; F04B 35/00

[52] U.S. Cl. ..... 417/363; 417/423 R; 248/604

[58] Field of Search ..... 417/423 L, 423 T, 423 R, 417/423 G, 363; 248/603, 604, 626; 267/154; 310/89, 91; 416/500

[56] References Cited

U.S. PATENT DOCUMENTS

| | | | |
|---|---|---|---|
| 2,000,386 | 5/1935 | Haynes | 248/604 |
| 2,881,995 | 4/1959 | Neher | 248/604 |
| 3,145,910 | 8/1964 | Jolly | 417/423 L |
| 3,317,124 | 5/1967 | Morrill | 417/423 L |
| 4,200,257 | 4/1980 | Litch, III | 417/423 L |
| 4,253,634 | 3/1981 | Daniels | 248/604 |
| 4,293,114 | 10/1981 | Lykes | 248/604 |

FOREIGN PATENT DOCUMENTS

| | | | |
|---|---|---|---|
| 1166138 | 11/1958 | France | 248/603 |
| 494973 | 11/1938 | United Kingdom | 248/603 |

*Primary Examiner*—Carlton R. Croyle
*Assistant Examiner*—Donald E. Stout
*Attorney, Agent, or Firm*—Allegretti, Newitt, Witcoff & McAndrews, Ltd.

[57] ABSTRACT

A combustion air blower assembly for a furnace includes a casing, a blower in said casing and a motor for driving said blower secured to said casing. This invention provides unique mounting means for securing the motor in close proximity to the casing, while allowing motor flexure in a direction radial to the axis of the motor to dissipate torsional vibration energy and maintaining the structural integrity of the motor in the axis thereof. The mounting means comprise a plurality of generally J-shaped isolation springs having a loop at each end. One loop of each isolation spring is secured to the casing and the other loop is secured to a bracket on the motor. Each isolation spring is generally flat and extends generally perpendicular from the wall of the casing to which the motor is secured.

3 Claims, 5 Drawing Figures

4722674

COMBUSTION AIR BLOWER MOTOR ISOLATING SPRING

BACKGROUND OF THE PRESENT INVENTION

This invention pertains to a combustion air blower assembly for a furnace and more particularly, to an improved motor mounting arrangement for securing a motor to the casing of the combustion air blower assembly.

In the past, the motor in a combustion air blower assembly has been secured directly to the casing by screw means. To help dissipate vibration energy, it was suggested to provide rubber vibration mounts or grommets between the screws and a frame secured to the motor. A deficiency of such mounting arrangement was a relatively high noise level. This noise level was considered undesirable. Further, there was sometimes undesirable axial movement of the motor relative to the casing.

An object of the present invention is to provide improved mounting means for mounting an electric drive motor on the housing or casing of a combination air blower assembly, wherein deficiencies and disadvantages of prior constructions are obviated.

Another object of the present invention is to provide improved mounting means for securing an electric drive motor in close proximity to the casing of a combustion air blower assembly, while allowing motor flexure in a direction radial to the axis of the motor to dissipate torsional vibration energy and maintaining the structural integrity of the motor in the axis thereof.

A further object of the present invention is to provide a generally J-shaped isolation spring for uniquely mounting an electric drive motor on the casing of a combustion air blower assembly.

Other objects and advantages of the present invention will become more apparent hereinafter.

BRIEF DESCRIPTION OF THE DRAWING

There is shown in the drawing a presently preferred embodiment of the present invention, wherein like numerals refer to like elements in the various views and wherein.

DETAILED DESCRIPTION OF THE INVENTION

Figure 1:
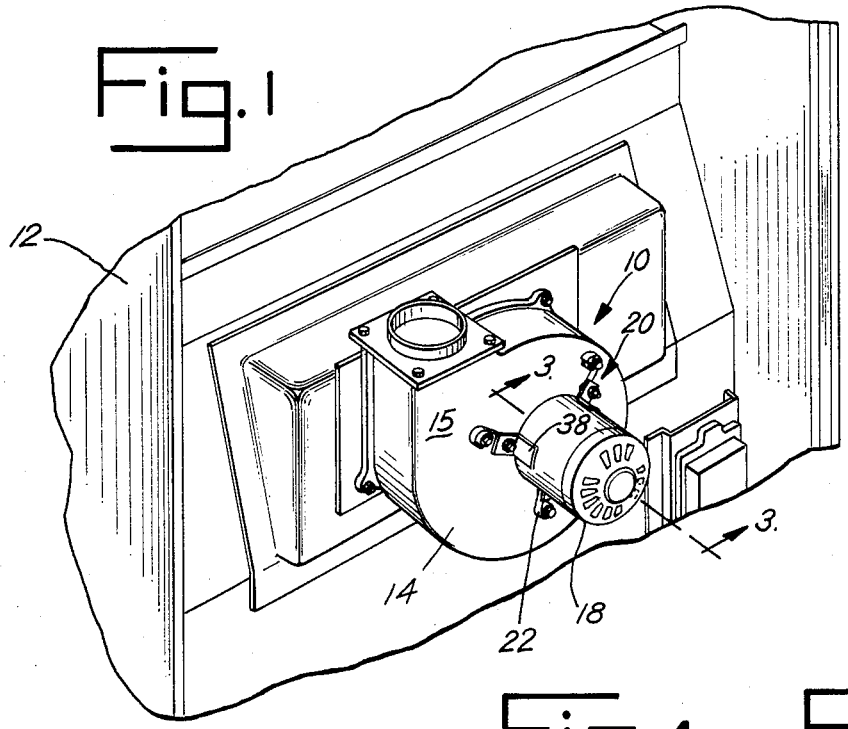
FIG. 1 is a perspective view of a combustion air blower motor mounted on the housing of the combustion air blower assembly with the isolation springs of the present invention.
Figure 4:
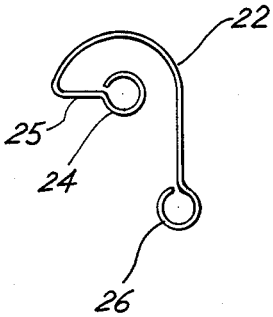
FIG. 4 is a side elevation view of an isolation spring.
Figure 5:
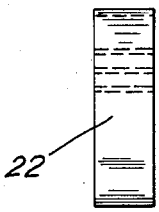
FIG. 5 is a rear view of an isolation spring.
Figure 2:
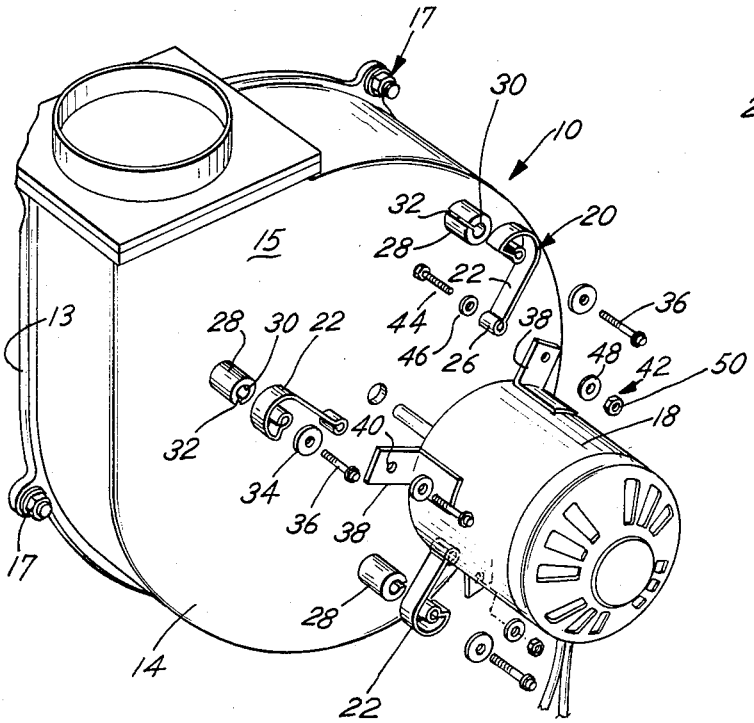
FIG. 2 is a partially exploded perspective view illustrating the use of the isolation springs of the present invention in mounting the blower motor on the housing of the combustion air blower assembly.
Figure 3:
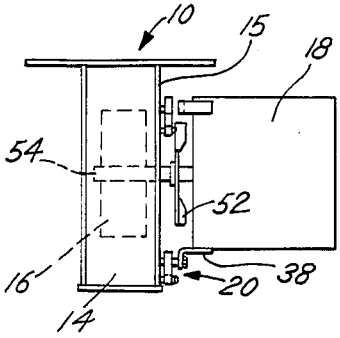
FIG. 3 is a detail cross sectional view taken generally along the line 3—3 of FIG. 1.

There is shown in FIGS. 1, 2 and 3 a combustion air blower assembly 10 in a furnace indicated generally by the numeral 12. The assembly 10 comprises a housing or casing 14 having a blower 16 therein adapted to be driven by an electric drive motor 18. The blower 16 is preferably a centrifugal blower. The casing 14 is preferably cast from metal, such as aluminum, and closed at the rear by a cover plate 13 which is secured to the casing 14 by suitable fastening means, for example, thread forming screws. Fastening means 17, for example, nuts and bolts secure blower assembly 10 to the furnace.

The electric drive motor 18 is secured to the casing 14 by the unique isolation spring means 20 of this invention. As shown, isolation spring means 20 includes three generally J-shaped isolation springs 22. Each spring 22 is formed at its ends with loops 24 and 26. The spring 22 is basically a flat resilient member, bent to J-shape. Each spring 22 is adapted to be secured to the casing 14 such that the axes through the loops 24 and 26 are each generally at right angles or perpendicular to the generally planar wall 15 of the casing 14. Stated differently, the axes through the loops 24 and 26 are parallel to the axis of the drive shaft 54 of motor 18.

Annular stud-like members 28 extend from the wall 15 of casing 14. Each stud 28 has an opening 30 adapted to receive a loop 24 of an associated spring 22. The side wall of each stud-like member 28 is slit as indicated at 32 for receiving the segment 25 of spring 22. The loop 24 of spring 22 is positioned within opening 30 of an associated stud-like member 28. Washer 34 is positioned over the end of the stud-like member 28 and screw or like fastening means 36 is used to secure loop 24 of isolation spring 22 in place.

Motor 18 has angle brackets 38 affixed thereto in suitable fashion, for example by welding. Each bracket 38 has an opening 40 in the leg extending from the motor 18. Fastening means 42 are employed to secure loop 26 of isolation spring 22 to each motor bracket 38. Fastening means 42 each preferably include a screw 44, a lock washer 46 on one side of loop 26, and a lock washer 48 and nut 50 on the opposite side of motor bracket 38.

As shown in FIG. 3, a cooling fan 52 may be provided on the motor drive shaft 54 between the motor 18 and blower 16.

The spring means 20 secures blower motor 18 in close proximity to the generally planar wall 15 of the casing 14, while allowing motor flexure in a direction radial to the axis of the motor 18 to dissipate torsional vibration energy and maintaining the structural integrity of the blower motor 18 in the axis thereof.

The sound output from the combustion air blower assembly at 120 HZ was reduced from 70 db with the motor "hard" mounted or conventionally mounted to the casing 14 to 52 db when mounted with the isolation spring means 20 of the invention.

While we have shown a presently preferred embodiment of the present invention, it will be apparent to those skilled in the art that the invention may be otherwise embodied within the scope of the appended claims.

What is claimed is:

1. For use with a combustion air blower assembly including a casing, a blower, and a motor for driving said blower secured to said casing, the improvement comprising mounting means for securing the motor in close proximity to the casing, while allowing motor flexure in a direction radial to the axis of the motor to dissipate torsional vibration energy and maintaining the structural integrity of the motor in the axis thereof, said mounting means comprising a plurality of isolation springs, each being secured at one end to said casing and at the other end to said motor, a plurality of studs extending from said casing and a plurality of flanges extending from said motor, each of said isolation springs being secured at one end to a stud and at the other end to a flange, screw and nut means for securing an end of each isolation spring to a flange and screw means for securing the other end of said isolation spring to a stud, each isolation spring being flat, each end of the isolation spring being formed with a loop and the axis through each loop being generally perpendicular to the wall of the casing to which the motor is secured.

2. A combustion air blower assembly as in claim 1 wherein each isolation spring comprises a generally J-shaped member secured at its ends to the casing and to the motor, respectively.

3. For use with a combustion air blower assembly including a casing, a blower, and a motor for driving said blower secured to said casing, the improvement comprising mounting means for securing the motor in close proximity to the casing, while allowing motor flexure in a direction radial to the axis of the motor to dissipate torsional vibration energy and maintaining the structural integrity of the motor in the axis thereof, said mounting means comprising plurality of isolation springs, each being secured at one end to said casing and at the other end to said motor, a plurality of studs extending from said casing and a plurality of flanges extending from said motor, each of said isolation springs being secured at one end to a stud and at the other end to a flange, first fastening means for securing an end of each isolation spring to a flange and second fastening means for securing the other end of said isolation spring to a stud, each isolation spring being flat, each end of the isolation spring being formed with a loop and the axis through each loop being generally perpendicular to the wall of the casing to which the motor is secured.

* * * * *